US009303643B2

(12) United States Patent
Schepp et al.

(10) Patent No.: US 9,303,643 B2
(45) Date of Patent: Apr. 5, 2016

(54) INTERNAL GEAR PUMP WITH AXIAL DISK AND INTERMEDIATE PIECE

(71) Applicant: Robert Bosch GmbH, Stuttgart (DE)

(72) Inventors: Rene Schepp, Wiablingen (DE); Norbert Alaze, Markgroeningen (DE); Edgar Kurz, Heilbronn-Horkheim (DE)

(73) Assignee: Robert Bosch GmbH, Stuttgart (DE)

( * ) Notice: Subject to any disclaimer, the term of this patent is extended or adjusted under 35 U.S.C. 154(b) by 8 days.

(21) Appl. No.: 14/207,971

(22) Filed: Mar. 13, 2014

(65) Prior Publication Data

US 2014/0271311 A1 Sep. 18, 2014

(30) Foreign Application Priority Data

Mar. 15, 2013 (DE) ..... 10 2013 204 616

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/08*** | (2006.01) |
| ***F04C 15/00*** | (2006.01) |
| ***F01C 1/10*** | (2006.01) |
| ***F01C 21/02*** | (2006.01) |
| ***F04C 2/10*** | (2006.01) |
| *F01C 21/10* | (2006.01) |
| *F04C 2/08* | (2006.01) |

(52) U.S. Cl.

CPC ..... *F04C 18/08* (2013.01); *F01C 1/102* (2013.01); *F01C 21/02* (2013.01); *F04C 2/101* (2013.01); *F04C 15/0026* (2013.01); *F01C 21/108* (2013.01); *F04C 2/086* (2013.01); *F04C 15/0034* (2013.01); *F04C 15/0038* (2013.01); *F04C 2240/52* (2013.01); *F04C 2240/56* (2013.01)

(58) Field of Classification Search

CPC ..... F04C 2/084; F04C 2/086; F04C 2/101; F04C 2/102; F04C 15/0026; F04C 15/0023; F04C 15/0034; F04C 2240/50; F04C 2240/56; F01C 21/02; F01C 21/108; F01C 1/102

USPC ..... 418/132–133, 166, 170–171, 102

See application file for complete search history.

(56) References Cited

U.S. PATENT DOCUMENTS

| | | | | |
|---|---|---|---|---|
| 4,132,515 | A * | 1/1979 | Kruger | 418/170 |
| 6,179,595 | B1 * | 1/2001 | Buchmuller | 418/170 |
| 6,450,792 | B1 * | 9/2002 | Eisenbacher et al. | 418/170 |
| 2012/0244028 | A1 * | 9/2012 | Schepp et al. | 418/170 |

* cited by examiner

*Primary Examiner* — Theresa Trieu

(74) *Attorney, Agent, or Firm* — Maginot, Moore & Beck LLP

(57) ABSTRACT

An internal gear pump includes a pinion and an annulus as a return pump in a hydraulic vehicle brake system. The internal gear pump further includes an axial disk and an intermediate piece. The intermediate piece is configured to be acted upon by an outlet pressure of the internal gear pump and press the axial disk against a side face of the pinion and of the annulus.

10 Claims, 2 Drawing Sheets

INTERNAL GEAR PUMP WITH AXIAL DISK AND INTERMEDIATE PIECE

This application claims priority under 35 U.S.C. §119 to patent application no. DE 10 2013 204 616.2 filed on Mar. 15, 2013 in Germany, the disclosure of which is incorporated herein by reference in its entirety.

BACKGROUND

The disclosure relates to an internal gear pump for a hydraulic vehicle brake system having the features of the disclosure. Internal gear pumps of this kind are used instead of conventionally used piston pumps in slip-controlled and/or power-operated vehicle brake systems and are often referred to, though not necessarily correctly, as return pumps.

Internal gear pumps are known. They have an annulus and a pinion, which is arranged eccentrically in the annulus and meshes over a segment of the circumference with the annulus. The annuluses are internally toothed gear wheels, the pinions are externally toothed gearwheels, and the annulus and the pinion can also be regarded as gearwheels of the internal gear pumps. The terms "pinion" and "annulus" are used to distinguish between them. Opposite the segment of the circumference over which the gearwheels mesh there is a crescent-shaped free space between the annulus and the pinion, which is here referred to as a pump space. Arranged in the pump space is a dividing element, on the outside and inside of which tooth tips of the two gearwheels rest and which divides the pump space into a suction space and a pressure space. Owing to its typical shape, the dividing element is often also referred to as a crescent or a crescent element. Another name for the dividing element is "filler piece". When driven in rotation, the gearwheels pump fluid from the suction space into the pressure space. The prior art also includes internal gear pumps without a dividing element, and these can be referred to as gear ring pumps for the sake of distinguishing them.

One known method of laterally delimiting and sealing the pump space is to use axial disks, which are also referred to as control or pressure disks or plates. They are fixed against relative rotation and are acted upon in a pressure field by an outlet pressure of the internal gear pump. The pressure field is a typically crescent-shaped shallow recess on a side of the axial disk approximately covering the pressure space which is remote from the pinion and the annulus. To seal the pressure field, a pressure field seal is required, and there is generally a backing ring, which supports the pressure field seal from the outside against the outlet pressure of the internal gear pump prevailing therein.

SUMMARY

The internal gear pump according to the disclosure has a pinion, an annulus, in which the pinion is arranged and which meshes with the annulus, and an axial disk on one side of the pinion and of the annulus, which rests on a side face of the pinion and of the annulus and laterally covers a pump space between the pinion and the annulus. The axial disk does not necessarily have to have the shape of a disk. There can likewise be an axial disk on the opposite side of the pinion and of the annulus, but there does not have to be a second axial disk. In addition, the internal gear pump according to the disclosure has an axially movable intermediate piece, which is arranged on a side of the axial disk remote from the pinion and the annulus and pushes the axial disk against the side face of the pinion and of the annulus and—where present—of a dividing element, which divides a pump space between the pinion and the annulus into a suction space and a pressure space, in order to laterally cover and seal the pump space or at least the pressure space. In this case, hermetic sealing is not required; instead, the axial disk can rest like an axial sliding bearing on the side face of the pinion and of the annulus, with the result that leaking occurs. The aim is an optimum compromise between low leakage and low friction. One advantage of the disclosure is that a pressure field and, in particular, a pressure field seal and the backing ring thereof, are eliminated. The assembly thereof is thereby also eliminated.

The dependent claims relate to advantageous embodiments and developments of the disclosure.

The intermediate piece can push the axial disk against the pinion and the annulus, resiliently for example. The intermediate piece is preferably pushed against the axial disk by means of an outlet pressure of the internal gear pump and presses it against the side face of the pinion, of the annulus and—where present—of the dividing element. As a result, an axial force which presses the axial disk against the side face of the pinion, of the annulus and—where present—of the dividing element is dependent on the outlet pressure of the internal gear pump, which corresponds to a pressure in the pressure space between the pinion and the annulus. This means that the axial disk is pressed axially against the side face of the pinion, of the annulus and—where present—of the dividing element with a small force in the case of a low pressure in the pressure space and with a large force in the case of a high pressure in the pressure space, and the pressure in the pressure space is compensated.

The disclosure envisages that a pump outlet of the internal gear pump leads out of the pump space or pressure space through the axial disk and through the intermediate piece. In this way, the axial force on the intermediate piece, which is dependent on the pressure in the pressure space of the internal gear pump, can be easily produced.

The disclosure provides a peripheral seal on the circumference of the intermediate piece to provide sealing in a pump housing or a receptacle for the internal gear pump, for example, the seal being integral with the intermediate piece. This embodiment eliminates a separate sealing ring for sealing off the internal gear pump.

In particular, the internal gear pump according to the disclosure is provided as a hydraulic pump for a hydraulic, slip-controlled and/or power-operated vehicle brake system instead of a conventionally used piston pump. In slip-controlled vehicle brake systems, hydraulic pumps are also referred to as return pumps. In this case, the internal gear pump according to the disclosure is used to build up brake pressure and/or to return brake fluid from wheel brakes to a brake master cylinder during a slip control operation or a brake pressure buildup for the actuation of a power-operated vehicle brake system. The internal gear pump is preferably installed in a receptacle in a hydraulic block. Such hydraulic blocks are known in slip control systems and are used for the mechanical fastening and hydraulic interconnection of hydraulic components of the slip control system. Apart from internal gear pumps, such components include solenoid valves and hydraulic accumulators for slip control. The hydraulic block is usually a cuboidal part made of metal, in particular aluminum, in which cylindrical counterbores, often with a stepped diameter, are made as receptacles for the hydraulic components of the slip control system, and holes are made to link or hydraulically interconnect the receptacles or the components installed therein.

BRIEF DESCRIPTION OF THE DRAWINGS

Further features of the disclosure will become apparent from the following description of an embodiment of the disclosure in conjunction with the claims and the drawings. The disclosure is explained in greater detail below by means of an embodiment illustrated in the drawings, in which:

DETAILED DESCRIPTION

Figure 2:
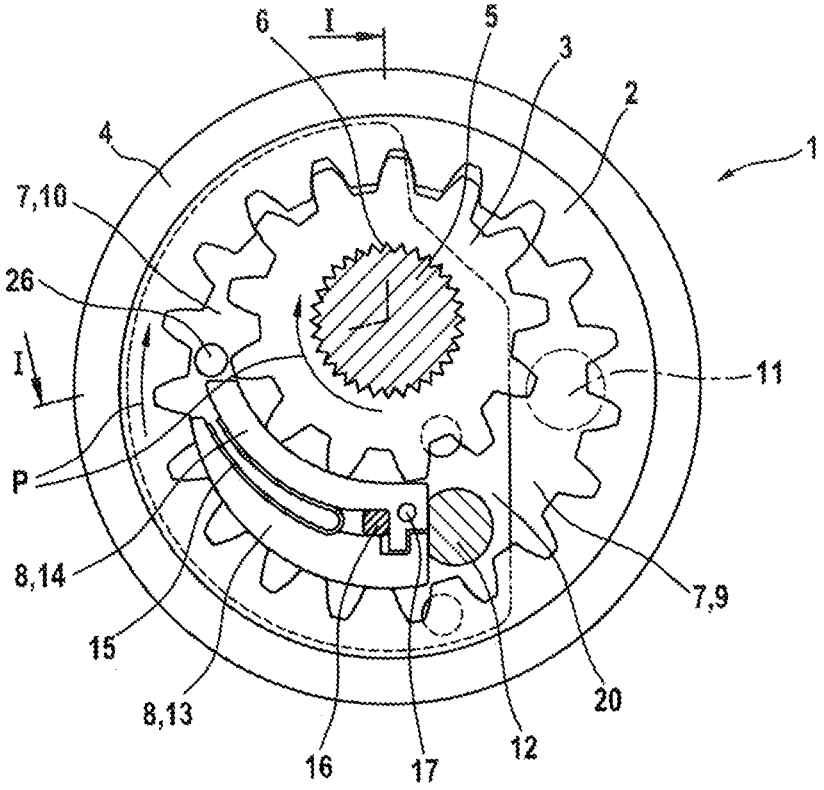
FIG. 2 shows an end view of the internal gear pump from FIG. 1.

The internal gear pump 1 according to the disclosure illustrated in the drawing has two gearwheels 2, 3, namely an internally toothed annulus 2 and an externally toothed gearwheel, here referred to as pinion 3. The pinion 3 is arranged eccentrically in the annulus 2, and the two gearwheels 2, 3 have mutually parallel axes and mesh with one another. The annulus 2 is press-fitted into a bearing ring 4, which is rotatably mounted in a sliding manner in a pump housing or a hydraulic block 40. The pinion 3 is arranged on a pump shaft 5 in a manner which prevents relative rotation and allows axial movement. To retain the pinion 3 on the pump shaft 5 in a manner which prevents relative rotation and allows axial movement, the pinion 3 and the pump shaft 5 have congruent triple square profiles 6 in the embodiment illustrated and described. To operate the internal gear pump 1, the pump shaft 5 is driven in rotation, and the pinion 3 fixed against relative rotation on the pump shaft 5 rotates with it and drives the meshing annulus 2 in rotation. A direction of rotation is indicated in FIG. 2 by the arrows P.

The gearwheels 2, 3 delimit between them a crescent-shaped pump space 7 in a segment of the circumference in which they do not mesh with one another. Arranged in the pump space 7 is a multi-part, crescent-shaped dividing element 8, which can also be regarded as part or half of a crescent shape and which is also often referred to as a crescent or crescent element owing to its shape. The dividing element 8 divides the pump space 7 into a suction space 9 and a pressure space 10. An inlet bore 11 opens into the suction space 9. Tooth tips of the gearwheels 2, 3 of the internal gear pump 1 rest on an outer side and an inner side of the dividing element 8, respectively, and slide along the outside and inside of the dividing element 8 when the gearwheels 2, 3 are driven in rotation. The dividing element 8 is the same width as the gearwheels 2, 3, which both have the same width. The dividing element 8 encloses liquid volumes in tooth gaps of the gearwheels 2, 3, with the result that driving the gearwheels 2, 3 in rotation causes fluid to be pumped from the suction space 9 to the pressure space 10. At a suction-space end, the dividing element 8 is supported on an abutment 12, which is formed by a pin which passes transversely through the pump space 7, i.e. parallel to the axis.

The dividing element 8 has an arc-shaped outer leg 13 and a likewise arc-shaped inner leg 14, which both extend from the abutment 12 in the direction of the pressure space 10. An outer side of the outer leg 13 is curved in a circular arc with the same radius as an addendum circle of the annulus 2, and the tooth tips of the teeth of the annulus 2 rest against it in a sealing manner and slide along it when driven in rotation. An inner side of the inner leg 14 is curved in a circular arc with the same radius as an addendum circle of the pinion 3, and the tooth tips of the teeth of the pinion 3 rest against it in a sealing manner and slide along it when driven in rotation. The tooth tips of the gearwheels 2, 3 do not have to rest in a hermetically sealed manner on the legs 13, 14 of the dividing element 8, a leakage flow being permissible. At an abutment-side and suction-space end, the legs 13, 14 are connected to one another in an articulated manner. A U-shaped leg spring 15 arranged between the legs 13, 14 pushes the legs 13, 14 apart and hence presses the outer leg 13 against the tooth tips of the annulus 2 and the inner leg 14 against the tooth tips of the pinion 3. A sealing element 16, which is arranged between the legs 13, 14, close to the abutment-side and suction-space end, provides a seal between the legs 13, 14 and axial disks 20, 21, which will be explained below. At the pressure-space end, the dividing element 8 is open, with the result that the interspace between the legs 13, 14 communicates with the pressure space 10.

On each side of its gearwheels 2, 3, the internal gear pump 1 has an axial disk 20, 21. The axial disks 20, 21 are penetrated by the pump shaft 5 and the pin forming the abutment 12 and are thereby held fixed against relative rotation, being axially movable. The axial disks 20, 21 are provided with holes for the passage of the pump shaft 5 and the abutment 12. They extend over more than 180° in the circumferential direction from the suction space 9, which they partially overlap, across the dividing element 8 and the pressure space 10. The inlet bore 11 opens ahead of the axial disks 20, 21 into the suction space 9 of the pump space 7, as seen in the direction P of rotation of the gearwheels 2, 3. The inlet bore 11 is situated outside the section plane of FIG. 1.

Axially adjacent to one of the two axial disks 20, on a side facing away from the gearwheels 2, 3, the internal gear pump 1 has a substantially cylindrical intermediate piece 22, through which the pump shaft 5 passes. To provide sealing between the intermediate piece 22 and the pump shaft 5, the intermediate piece 22 has a radial shaft sealing ring as a shaft seal 23.

A pump outlet 26 of the internal gear pump 1 leads out of the pressure space 10, through a through hole in the axial disk 20, which is situated between the annulus 2, the pinion 3 and the dividing element 8 on one side and the intermediate piece 22 on the other side, and through an angled bore, which extends in the intermediate piece 22, initially parallel to the axis and then radially outward to a circumference of the intermediate piece 22. At a transition from the axial disk 20 to the intermediate piece 22, the pump outlet 26 can be sealed off with a seal surrounding it. Where present, a seal of this kind is preferably embodied integrally with the intermediate piece 22, which is composed of plastic, e.g. as a raised sealing bead, sealing rib or sealing lip surrounding the pump outlet 26. It is also possible to form the seal integrally with the axial disk 20 or to provide a separate seal, e.g. a sealing ring, which surrounds the pump outlet 26. In the illustrative embodiment, there is no special seal for the pump outlet 26 between the axial disk 20 and the intermediate piece 22, the intermediate piece 22 providing a seal by flat contact with the axial disk 20.

In a direction away from the axial disk 20, the intermediate piece 22 tapers with an annular step 27, which is situated axially approximately in the center of the intermediate piece 22 in the embodiment. The annular step 27 forms a peripheral sealing edge 28 which seals the intermediate piece 22 at the outer circumference thereof. On a side of the annular step 27 which faces away from the axial disk 20, the pump outlet 26 opens at the circumference of the intermediate piece 22, with the result that the annular step 27 communicates by means of the pump outlet 26 with the pressure space 10 and is thereby subjected to the outlet pressure of the internal gear pump 1. The application of pressure to the annular step 27 causes an axial force, which pushes the intermediate piece 22 against the axial disk 20 and the axial disk 20 into sealing contact with the side face of the pinion 3, of the annulus 2 and of the dividing element 8.

The pinion 3, the annulus 2 and the dividing element 8 are axially movable and are pressed by means of the side faces thereof against the axial disk 21 on the opposite side of the intermediate piece 22, with the result that the pump space 7 or at least the pressure space 10 is sealed off on both sides of the pinion 3, of the annulus 2 and of the dividing element 8. The axial disk 21 on the opposite side of the intermediate piece 22 rests on a base of a receptacle 39, in which the internal gear pump 1 is installed. The axial disk 21 is thereby supported axially. The bearing ring 4 into which the annulus 2 is press-fitted is narrower than the two axial disks 20, 21 and the gearwheels 2, 3 together, with the result that the annulus 2 is axially movable. Sealing between the axial disks 20, 21 and the gearwheels 2, 3 is not hermetic; instead, the axial disks 20, 21 rest against the side faces of the gearwheels 2, 3, like axial sliding bearings, and therefore there is leakage. It is important to find a good compromise between a good sealing effect and low friction. Because the intermediate piece 22 is subjected on its annular step 27 to the outlet pressure prevailing in the pressure space 10 of the internal gear pump 1, there is pressure compensation and the axial disks 20, 21 press against the side faces of the gearwheels 2, 3 of the internal gear pump 1 with a small force at low pressure. A size of the area of the annular step 27 is dependent on a radial height of the annular step 27, thereby enabling the axial force to be adjusted.

The application of pressure to the annular step 27 also brings about sealing contact of the sealing edge 28. The sealing edge 28 can be regarded in general terms as a peripheral seal on the circumference of the intermediate piece 22, and the sealing edge 28 or seal is integral with the intermediate piece 22, which is composed of plastic.

On a side facing away from the axial disk 20, the intermediate piece 22 is sealed off by a sealing ring 29, in the illustrated embodiment an O-ring. Between the sealing edge 28 and the sealing ring 29 there is a peripheral groove 30, into which the pump outlet 26 opens and which is part of the pump outlet.

On a side facing away from the axial disk 20, axially adjacent to the intermediate piece 22, the internal gear pump 1 has an end plate 31 with a shaft bearing 32. The end plate 31 is a sheet metal circular-hole disk, on which a cup-shaped and cylindrical bearing receptacle 33 for the shaft bearing 32 is formed by deep drawing, into which the shaft bearing 32 is press-fitted. In the embodiment illustrated, the shaft bearing 32 is a ball bearing, the outer ring of which, as stated, is press-fitted into the bearing receptacle 33 of the end plate 31 and into the inner ring of which the pump shaft 5 is press-fitted. In this embodiment, the shaft bearing 32 is thus a fixed bearing, which holds the pump shaft 5 in an axially fixed manner. On the opposite side of the pinion 3, the pump shaft 5 is rotatably mounted in a bearing bush 34, in which the pump shaft 5 is also axially movable, i.e. the bearing bush 34 forms a floating bearing for the pump shaft 5.

The shaft bearing 32 is coaxial with the pump shaft 5 and the pinion 3 and thus, in accordance with an eccentricity of the pinion 3 in the annulus 2, is eccentric with respect to the annulus 2 and to the end plate 31 or the circumference thereof, which is coaxial with the annulus 2.

The pump shaft 5 passes with an annular gap 35 surrounding it through a hole in the end plate 31. On a side of the end plate 31 facing away from the intermediate piece 22, a gearwheel is pressed as a driving wheel 36 onto the pump shaft 5, said gearwheel meshing with a gearwheel 37, which can be driven by electric motor.

On the side of the intermediate piece 22, the shaft bearing 32 projects a short distance axially out of the bearing receptacle 33 of the end plate 31 and engages in a cylindrical counterbore 38 in the intermediate piece 22, thereby centering the intermediate piece 22.

The internal gear pump 1 can have a pump housing, also in the form of a cartridge (not shown). In this embodiment, the internal gear pump 1 is inserted into a receptacle 39 in a hydraulic block 40. Hydraulic blocks are known from slip control systems of hydraulic vehicle brake systems. They are used for the mechanical fastening and hydraulic interconnection of hydraulic components of the slip control system. Hydraulic blocks are typically cuboidal parts made of metal, generally of aluminum, and have counterbores as receptacles for hydraulic components, such as hydraulic pumps, solenoid valves and hydraulic accumulators, which are linked by bores, i.e. are hydraulically interconnected. The hydraulic block fitted with the components can also be regarded as a hydraulic unit of a slip control system. It has one internal gear pump 1 for each brake circuit, that is to say two internal gear pumps 1 for a dual circuit vehicle brake system, these preferably being driven jointly with the gearwheel 37, which can be driven by electric motor.

Figure 1:
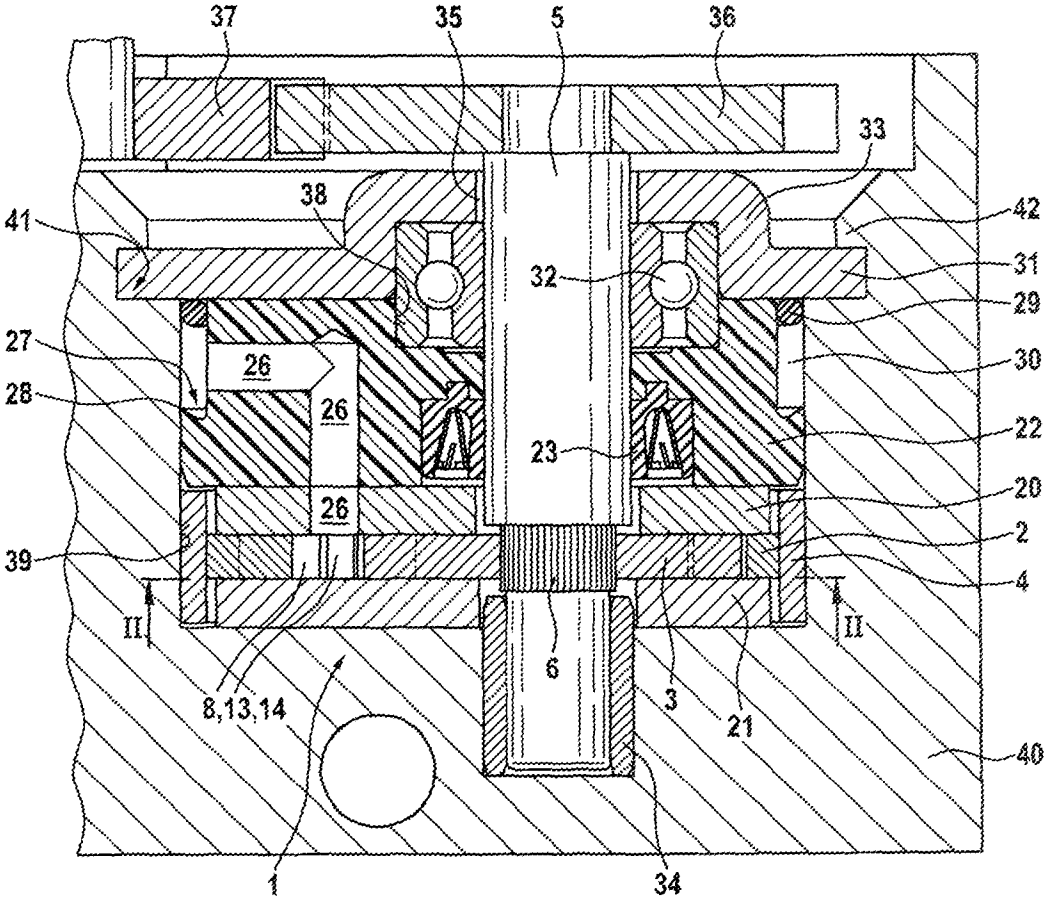
FIG. 1 shows an angled axial section through an internal gear pump according to the disclosure along the line I-I in FIG. 2.

The axial disk 21 on the opposite side of the annulus 2 and of the pinion 3 from the intermediate piece 22 rests on a base of the receptacle 39. The inlet bore 11 opens parallel to the axis into the suction space 9, at the base of the receptacle 39, i.e. outside the axial disk 21. The inlet bore 11 is not covered by the axial disk 21. In FIG. 2, the inlet bore 11 opens in front of the plane of the drawing, for which reason its position is indicated by chain-dotted lines. In FIG. 1, the inlet bore is outside the section plane and is therefore not visible.

A bore in the hydraulic block 40, through which further hydraulic components (not shown) of the slip control system are connected to the internal gear pump 1, opens into the groove 30 which surrounds the intermediate piece 22 and into which the pump outlet 26 opens. In FIG. 1, the bore is covered by the intermediate piece 22 and is therefore not visible.

The end plate 31 is inserted into the receptacle 39 at an annular step 41 close to a mouth of the receptacle 39 and is secured by staking 42.

The internal gear pump 1 is provided as a hydraulic pump in a hydraulic motor vehicle brake system (not shown), where it is used as a "return pump" for slip control operations, such as antilock braking, traction control and/or vehicle dynamics control operations and/or for producing brake pressure in a hydraulic power-operated vehicle brake system. For the slip control operations mentioned, the abbreviations ABS, ASR, FDR, ESP are customary, and vehicle dynamics control operations are also referred to colloquially as antiskid control operations.

What is claimed is:

1. An internal gear pump for a hydraulic vehicle brake system, comprising:

an annulus;

a pinion arranged in the annulus and configured to mesh with the annulus;

an axial disk resting on a side face of the pinion and of the annulus, the axial disk being fixed against relative rotation and configured for axial movement; and an axially movable intermediate piece arranged on a side of the axial disk remote from the pinion and the annulus, the intermediate piece being configured to push the axial disk against the side face of the pinion and of the annulus, wherein the intermediate piece has an annular step that faces away from the axial disk and that is subjected to the outlet pressure of the internal gear pump.

2. The internal gear pump according to claim 1, wherein the pinion and the annulus are axially movable.

3. The internal gear pump according to claim 1, wherein the internal gear pump has an end plate that holds a shaft bearing rotatably supporting a pump shaft of the internal gear pump.

4. The internal gear pump according to claim 3, wherein the shaft bearing is a fixed bearing that holds the pump shaft axially and is held axially by the end plate.

5. The internal gear pump according to claim 4, wherein the pinion is arranged in a manner that prevents relative rotation and allows axial movement on the pump shaft.

6. An internal gear pump for a hydraulic vehicle brake system, comprising:

an annulus;

a pinion arranged in the annulus and configured to mesh with the annulus;

an axial disk resting on a side face of the pinion and of the annulus, the axial disk being fixed against relative rotation and configured for axial movement; and an axially movable intermediate piece arranged on a side of the axial disk remote from the pinion and the annulus, the intermediate piece being configured to push the axial disk against the side face of the pinion and of the annulus, wherein the intermediate piece has on its circumference a peripheral seal integral therewith.

7. The internal gear pump according to claim 6, wherein the pinion and the annulus are axially movable.

8. The internal gear pump according to claim 6, wherein the internal gear pump has an end plate that holds a shaft bearing rotatably supporting a pump shaft of the internal gear pump.

9. The internal gear pump according to claim 8, wherein the shaft bearing is a fixed bearing that holds the pump shaft axially and is held axially by the end plate.

10. The internal gear pump according to claim 9, wherein the pinion is arranged in a manner that prevents relative rotation and allows axial movement on the pump shaft.

* * * * *